US005618458A

United States Patent [19]

Thomas

[11] Patent Number: 5,618,458

[45] Date of Patent: Apr. 8, 1997

[54] COOKING APPLIANCE

[76] Inventor: Peris W. Thomas, 17 Gaddum Road, Bowdon, Cheshire, England

[21] Appl. No.: 438,566

[22] Filed: May 10, 1995

[30] Foreign Application Priority Data

| | | | |
|---|---|---|---|
| May 10, 1994 | [GB] | United Kingdom | 9409257 |
| Dec. 8, 1994 | [GB] | United Kingdom | 9424832 |
| Feb. 10, 1995 | [GB] | United Kingdom | 9502559 |

[51] Int. Cl.[6] ..... A21B 1/22; F27D 11/02; H05B 3/68; F24C 15/16

[52] U.S. Cl. ..... 219/394; 219/395; 219/396; 219/403; 219/414; 219/446; 219/447; 126/194; 126/337 R

[58] Field of Search ..... 219/214, 387, 219/391, 394, 395, 396, 400, 403, 414, 446, 447, 448; 126/190, 194, 273 R, 337 R; 99/DIG. 14; 160/205, 220; 49/371; 312/276

[56] References Cited

U.S. PATENT DOCUMENTS

| | | | |
|---|---|---|---|
| 2,994,760 | 8/1961 | Pecoraro et al. | 219/394 |
| 3,143,638 | 8/1964 | Scott | 219/395 |
| 3,176,118 | 3/1965 | Scott | 219/395 |
| 4,131,786 | 12/1978 | Cooper | 219/487 |
| 4,149,518 | 4/1979 | Schmidt et al. | 126/190 |
| 4,251,716 | 2/1981 | Lewis et al. | 219/446 |
| 4,431,907 | 2/1984 | Barnett | 219/446 |
| 4,780,597 | 10/1988 | Linhart et al. | 219/396 |
| 5,183,996 | 2/1993 | Hazan et al. | 219/446 |
| 5,321,229 | 6/1994 | Holling | 218/448 |

*Primary Examiner*—Teresa J. Walberg
*Assistant Examiner*—J. Pelham
*Attorney, Agent, or Firm*—Dennison, Meserole, Pollack & Scheiner

[57] ABSTRACT

A cooking appliance is disclosed which comprises an oven intended to be built into a space of predetermined volume in a kitchen unit. Controls for the oven are mounted externally of the space in order to maximise the volume available for the oven cavity. In preferred embodiments, the oven has a partition to divide its cavity into a plurality of cooking spaces. In a further preferred embodiment, the oven has a door assembly having a plurality of leaves which can be opened individually or together to give access to the whole cavity.

15 Claims, 7 Drawing Sheets

COOKING APPLIANCE

BACKGROUND TO THE INVENTION

2. Field of the Invention

The present invention relates to a cooking appliance, and in particular one incorporating a single or dual cavity oven.

Various types of cooking appliance are known, powered by gas, electricity or other fuels, which fit broadly into two categories. The first category is the "all-in-one" cooker consisting, typically, of an oven having one or two cooking cavities (one of which may incorporate a grill), on top of which is located a hob having a plurality of cooking elements, and above which there may be located an extractor fan or a grill. This type of cooker is designed to stand along i.e not to be incorporated into an item of kitchen furniture.

The second general type of cooking appliance has a separate oven and hob unit. This type of cooking appliance is designed to be mounted in or around one or more items of kitchen furniture. Typically, there are two configurations in which such a cooking appliance is mounted: (I) with the oven unit located under a work top and the hob unit mounted on the work top at a separate location, or (ii) with the oven unit in a "stack" or "tall oven housing", usually at eye level for a user, and again with the hob unit being mounted on a work top at some separate location.

In both of these arrangements, a fixed volume is available for mounting the oven, the size of which is defined by relevant local, national and international standards, this imposing a limit on the maximum size of oven that can be provided.

2. Summary of the Prior Art

It is standard practice within the art, as typified in GB-A-2220739, to provide the controls for the oven in a control panel which is included as part of the oven unit, either above or at the side of the oven cavity. So strong is this preference within the art that, even where a proposal is made to provide separable controls, as in GB-A-2015870 or EP-A-578600, the space that the controls would normally occupy remains as an unoccupied blank within the volume of the oven unit.

The applicant has realised that this long-accepted teaching is, in fact, disadvantageous, because a portion of the fixed space is taken up by the control panel and associated control circuitry, thereby reducing the space available to the oven cavity.

There are additional disadvantages of this arrangement. The control panel and control circuitry being located on the oven unit, may be adversely effected by the heat produced by the oven when in use. Mounting of the controls on a front panel of the oven unit may place them such as to be within the reach of children. Provision of controls on the oven unit may also reduce the versatility of the use to which the oven unit may be put.

The last of these disadvantages can be commercially very serious. As an example, within the European market, ovens are generally of a vertical orientation. That is to say, the oven cavity is taller than it is wide. However, in American and Australasian markets, ovens of a horizontal orientation are often sold. That is, such ovens are wider then they are tall. This requires manufacturers to multiply the number of different oven chassis that they must produce if both orientations are to be provided, since an oven having controls attached cannot simply be rotated for use in an alternative configuration.

A further problem with all of the above types of cooking appliances is that the size of the oven cavity (or oven cavities if there is more than one oven provided) is fixed. Also the location and function of the heating means for heating the oven is fixed.

SUMMARY OF THE INVENTION

It is the aim of the present invention to provide a cooking appliance which mitigates some or all of these disadvantages.

Accordingly, in a first aspect, the present invention provides a cooking appliance comprising an oven unit adapted for fitting in a space having a standard mounting volume and a control unit for the oven unit, the control unit incorporating at least one control operable by the user to control operation of the oven unit, the control unit being located remote from the oven unit, outside of the said space.

Thus, there is no need for any oven controls, such as a control panel or associated circuitry, to be mounted in association within the fixed volume space. Therefore the capacity of the oven unit can be increased to the maximum permitted by the space provided by limits of the standards to which it must adhere. This enables the oven unit to utilise the full extent of the space provided between e.g. two adjacent kitchen units, and between a plinth and a work top.

Also, as the control means for the oven unit are remote from the oven unit, any effect of the heat produced by the oven on the controls is reduced or eliminated.

Moreover, the orientation of the oven chassis no longer influences the position of the controls, so allowing greater flexibility in its use.

The control unit for the oven unit is preferably located in or on a hob unit, possibly together with control means for the hob unit.

The oven unit may be mountable either beneath a work top or in a stack. In either of these situations, the oven unit may be mountable either horizontally or vertically, as discussed above. If the oven unit has more than one cooking space e.g. if there is a dual oven, or an oven and grill, these may be located either side by side (in the horizontal position) or one on top of the other (in the vertical position).

In a second aspect, the present invention provides a control unit for a cooking appliance comprising one or more hob controls, each adapted to control a respective cooking element of a hob unit and one or more oven controls each adapted to control a respective cooking space of an oven unit, the control unit being adapted for mounting remote from the oven unit. The control unit may be adapted to be mounted at or in a hob unit.

In a third aspect, the invention comprises a kitchen unit assembly having a space of a standard volume for mounting an oven, in which an oven is mounted, controls for the oven being mounted remote from the space, the oven having a cooking cavity of volume maximised within the available space.

In a fourth of its aspects the invention provides an oven unit comprising an oven cavity into which food to be cooked in placed, and a partition received within the cavity to divide that cavity into a plurality of cooking spaces, a cooking temperature of each cooking space being independently controllable.

This provides for substantially increased versatility. The oven unit may be configured either to have one large cooking space or a plurality of smaller cooking spaces.

The partition may itself carry heating means to heat one or more cooking space of the oven. (The heating means can include electric heating elements, hot air blowers, microwave sources, and so on.)

Yet further versatility can be achieved by providing for a plurality of positions into which the partition may be inserted, so providing selectably cooking spaces of various sizes. A plurality of partitions may, in each arrangement, be inserted simultaneously to further divide the oven cavity. The partition may be permanently installed at manufacture of the oven unit or may, alternatively, be removable by the user so as to provide an oven configurable to a particular cooking task.

Preferably a sensing means is provided to detect the presence and, where appropriate, position of the partition, and to send a signal to the control unit to influence its operation appropriately. For example, where no partition is inserted, the control unit operates such that a single control operates to control the temperature of the whole oven whereas when the partition is in place, each cooking space has a respective control.

The fourth aspect of the present invention may be used separately or in conjunction with the first and second aspect of the present invention. The cooking appliance of the present invention may be of either of the above described general types.

The oven unit of the present invention may be provided with either a single door or a plurality of doors, e.g. one for each cooking space, or most preferably a door according to the fourth aspect of the invention. Where a single door is provided, the door may be collapsible or foldable so that the door may either, when closed, seal the entire oven or alternatively seal only a part or section of the oven e.g a cooking space formed on insertion of a partition as described above. In the latter case, for example, the main oven cavity may be sealable whilst a smaller oven cavity is left unsealed for use e.g. as a grill.

The oven and/or hob units may be heated with gas or electric fuel, or a combination of the two, and heating may be by convection, induction or microwave cooking systems, or any combination thereof. Ventilation of the oven may be provided.

A further aspect of the present invention relates to a door assembly. Most particularly, a door assembly of the present invention will be adapted for use on a cooking appliance, such as those according to the preceding aspects of the invention, but its application is not limited to such appliances. A door assembly of this aspect of the present invention might also be used on items of furniture, and in many other circumstances where a door is provided to cover an aperture.

There are many occasions where an aperture must be covered by a door in a manner which it can be readily opened. From time to time, it becomes desirable that selective parts of the door can be opened independently. However, when a plurality of door leaves is provided, it often happens that the ability to open the entire aperture is lost. A particular example is a cooking appliance in accordance with the preceding aspects of the invention. In normal use it may be convenient for each cooking space to be provided with its own opening door. However, it might also be desirable, in some circumstances, to allow uninterrupted access to the entire cavity, for instance to remove a partition dividing the two cooking spaces from one another. However, with a conventional arrangement, where each cooking space has its own, fixed door, this is not possible.

The present invention provides, in a fifth of its aspects, a door assembly comprising first and second leaves arranged, in a closed condition, to be adjacent one another and each hingedly mounted to be openable independently of the other through pivoting about a respective axis to reveal a respective opening, in which the first leaf is mounted such that its axis is displaceable towards the axis of the second leaf, in which displaced condition opening of the first and second leaves reveals a single opening of size greater than that of either said respective opening.

Thus, in application to a cooking appliance, in normal use each leaf is opened and closed separately to give access to the corresponding cooking space. However, when access to the entire oven cavity is required, the axis of the first leaf is displaced towards that of the second, whereupon with both leaves open to allow uninterrupted access to substantially the entire oven cavity.

Preferably, the first leaf is mounted on a linkage assembly, the assembly having hinge components to which the leaf is hingedly mounted, the hinge components being carried so as to be displaceable. More preferably, the linkage is disposed such that displacement of the hinge components causes a part of the assembly to urge the second door leaf from its closed condition towards its open condition. In an arrangement such as this, once the first leaf has been displaced, opening it will cause the second leaf to be urged further towards its open condition (for example, by direct contact with the first leaf) in order that the opening movement of the first leaf is not inhibited. The hinge components may cause displacement of a leaf as it is opened in addition to pivotal movement.

Preferably, the door assembly further includes control means whereby displacing movement of the first leaf is restricted to a path substantially normal to its hinging axis, and rotation of the first leaf about any other axis is inhibited. Such control means may suitably comprise tensioned wires disposed so as to cause displacement of one of the hinge parts to be similarly imposed on the other hinge part.

In a typical arrangement, the first and second axes are horizontal, the first being disposed above the second. In this way, displacement of the first leaf can be accomplished by a downward push on a upper part of the leaf. This arrangement is particularly suitable for use in a cooking appliance having a horizontally divided oven cavity.

DETAILED DESCRIPTION OF PREFERRED EMBODIMENTS

Figure 1:
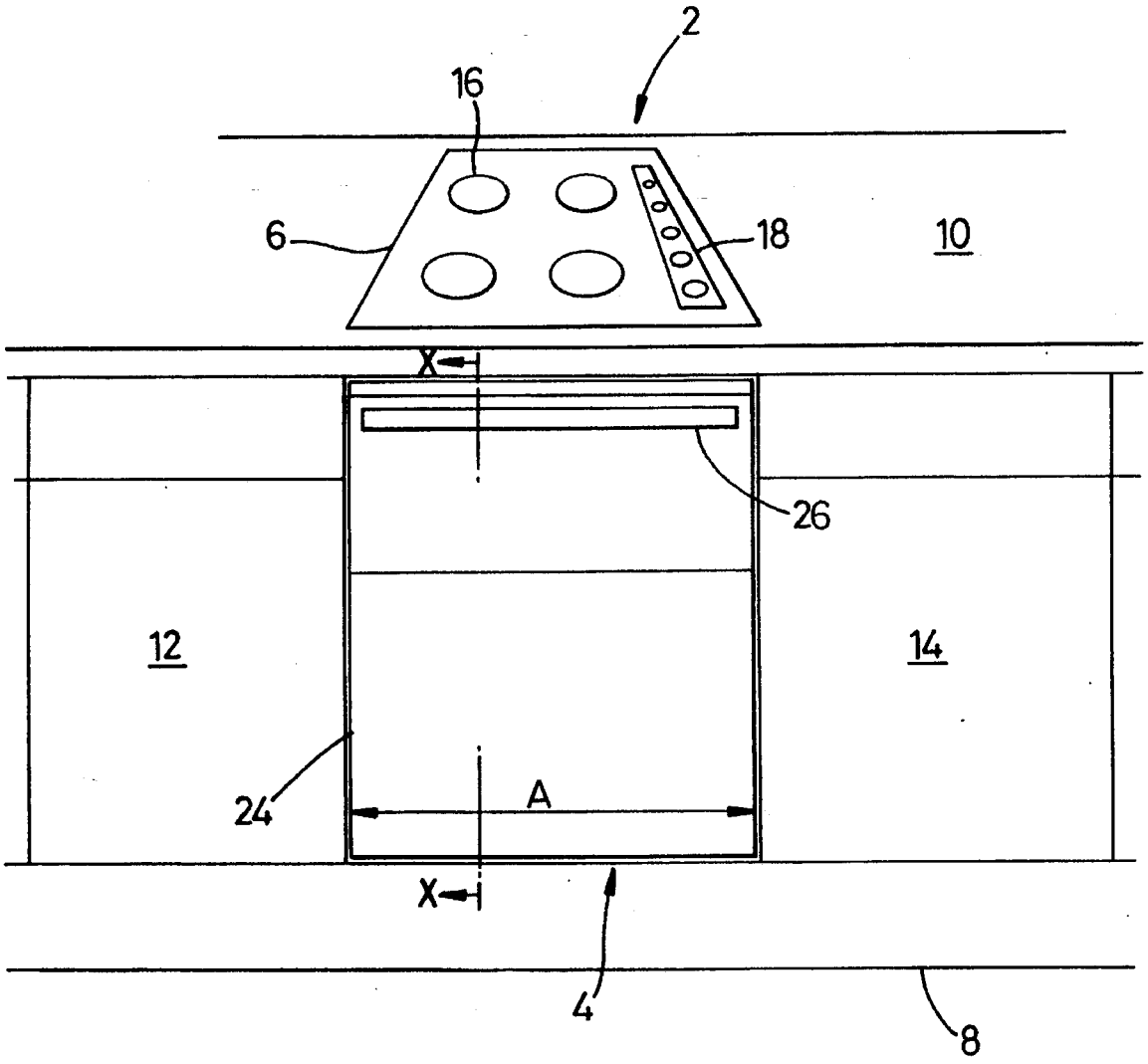
FIG. 1 shows a first cooking appliance embodying the present invention with the oven unit mounted in a vertical orientation under a kitchen work top.

FIG. 1 shows a cooking appliance 2 having an oven unit 4 and a hob, unit 6. The oven unit 4 is mounted above a plinth 8, below a work top 10 and between two kitchen units 12, 14.

The hob unit 6 includes a plurality of cooking elements 16 and a control panel 18. The cooking elements 16 may comprise electric heating elements, halogen lamps, inductive cooking plates, gas burners, or any other type of hob cooking arrangement. The control panel includes controls operable by a user to control both the hob unit 6 and the oven unit 4.

Thus, the oven cavity provided inside the oven unit 4 may utilise the maximum amount of space permitted by the arrangement of the items of kitchen furniture 8, 10, 12, 14, none of this space being occupied by the control unit. Typically, the width (marked "A") is 60 cm, although this may vary depending on the place of origin of the kitchen furniture and the country in which it is intended to be used.

Figure 2:
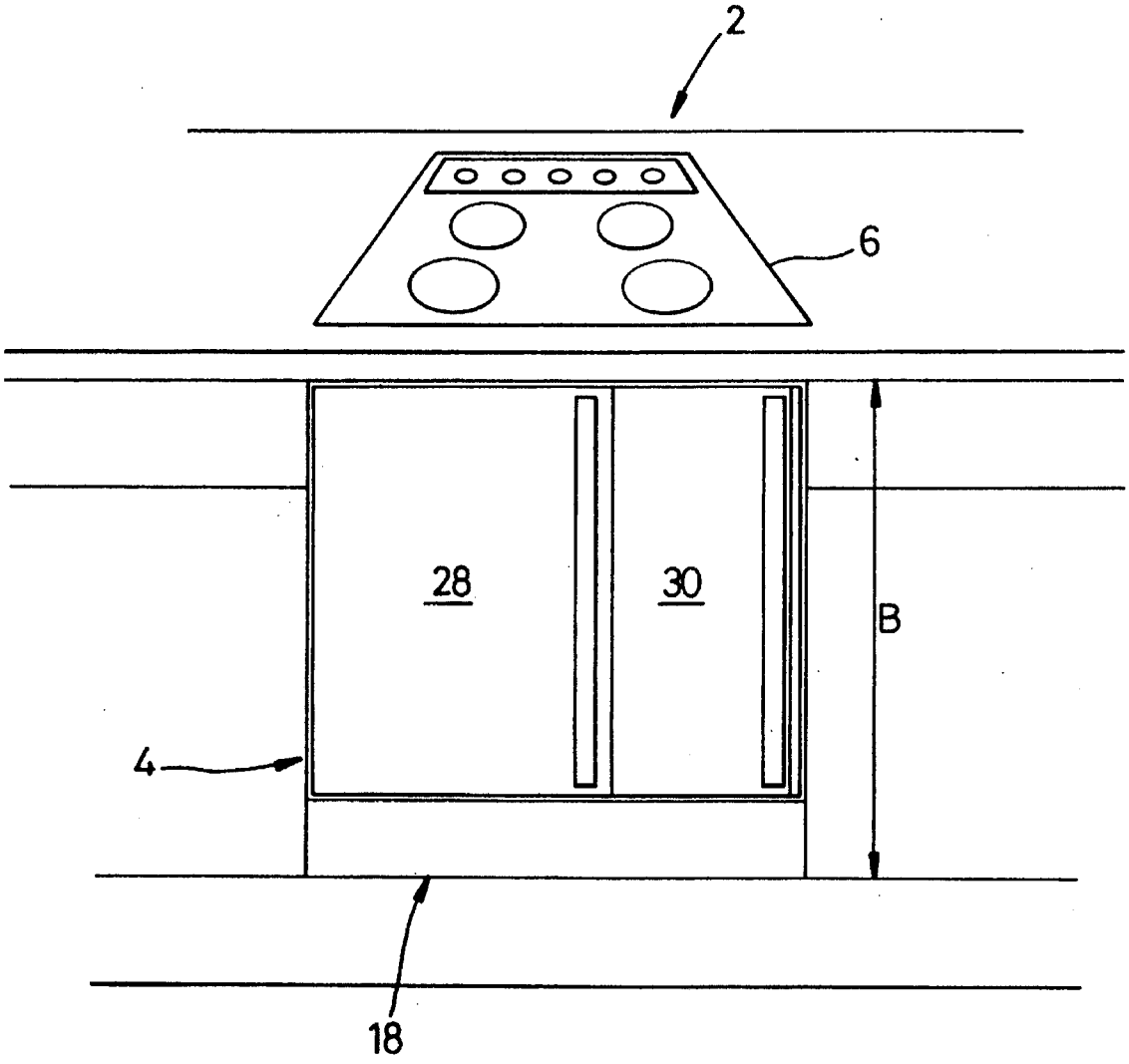
FIG. 2 shows a second cooking appliance embodying the present invention with the oven unit mounted in a horizontal orientation under a kitchen work top.

FIG. 2 shows a second cooking appliance 2, similar to that of FIG. 1. In this appliance, the oven unit 4 is mounted in a horizontal orientation. That is to say, the oven cavity is wider than it is high. A filling member 18 is used to fill any space left empty by any difference in the height of the oven unit 4 and the height (marked dimension "B") of the kitchen units 12, 14.

The oven unit 4 may be constructed from the same chassis as that of FIG. 1. In this embodiment, the oven unit 4 comprises a partition disposed vertically to provide two side-by-side cooking spaces, respectively one third and thirds of the oven cavity. The partition is permanently installed during manufacture and carries heating elements on both sides to provide heating to each of the cooking spaces. In this example, the oven unit is provided with two substantially conventional doors 28, 30, each door being for sealing a corresponding cooking space 20, 22.

Figure 3:
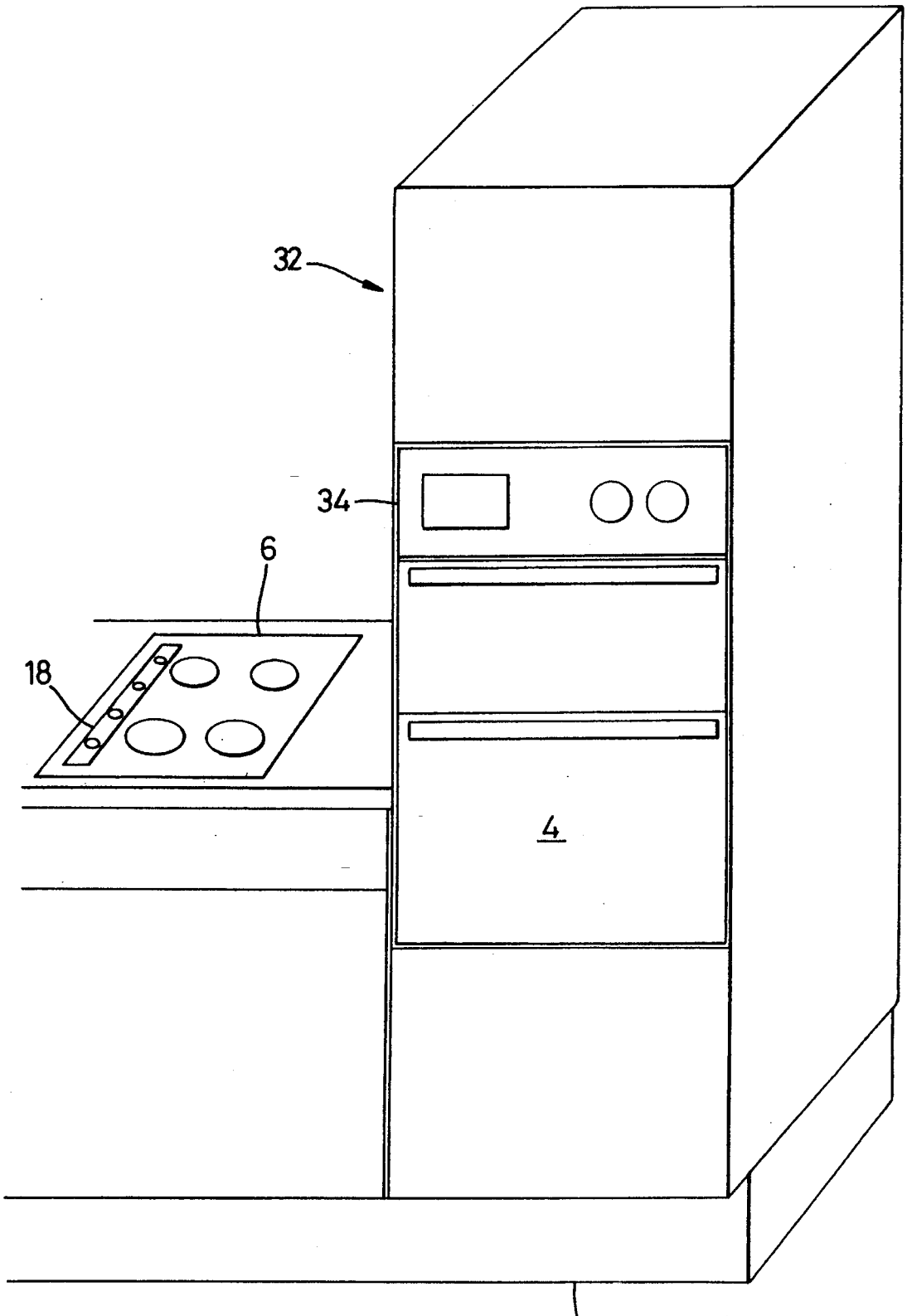
FIG. 3 shows a third cooking appliance embodying the present invention with the oven unit mounted in a stack.

FIG. 3 shows a third cooking appliance embodiment the present invention in which the oven unit 4 is mounted in a stack 32, with the oven unit 4 being at or around eye level to a user. A control unit for the oven unit 4 may be provided either in association with a control panel 19 of the hob unit 6, or separately in a control panel 34 mounted in the stack 32.

Figure 4:
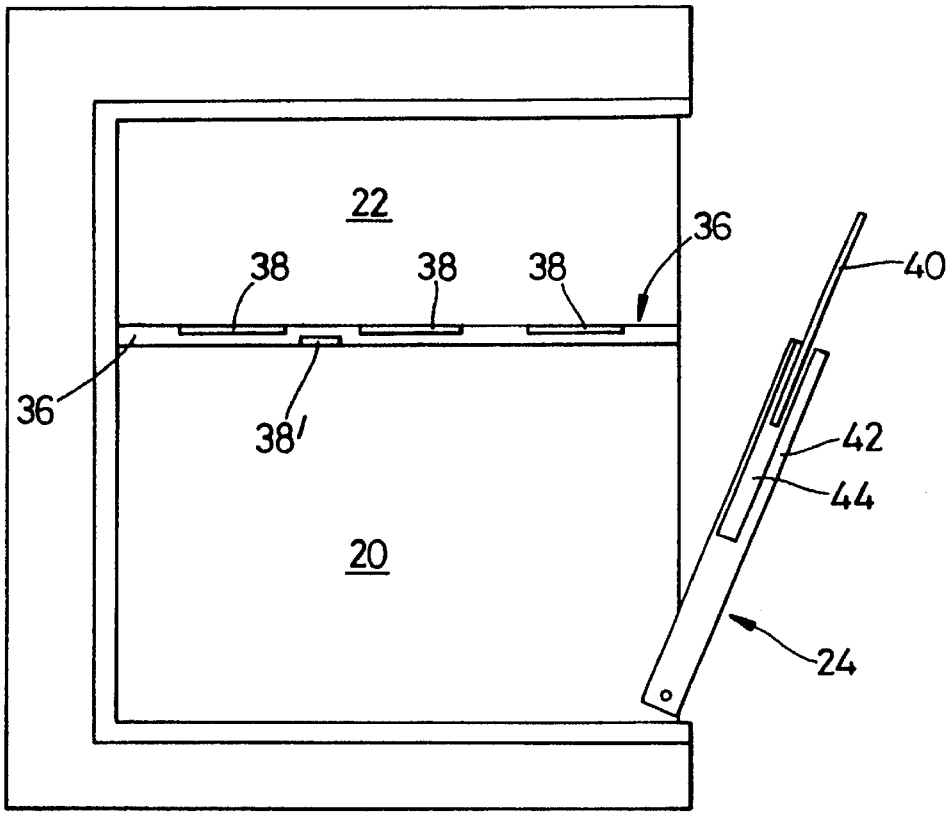
FIGS. 4 and 5 show, respectively, a partial cross-section through and a perspective view of an oven chassis of the first cooking appliance embodying the present invention along the line X—X of FIG. 1.
Figure 5:
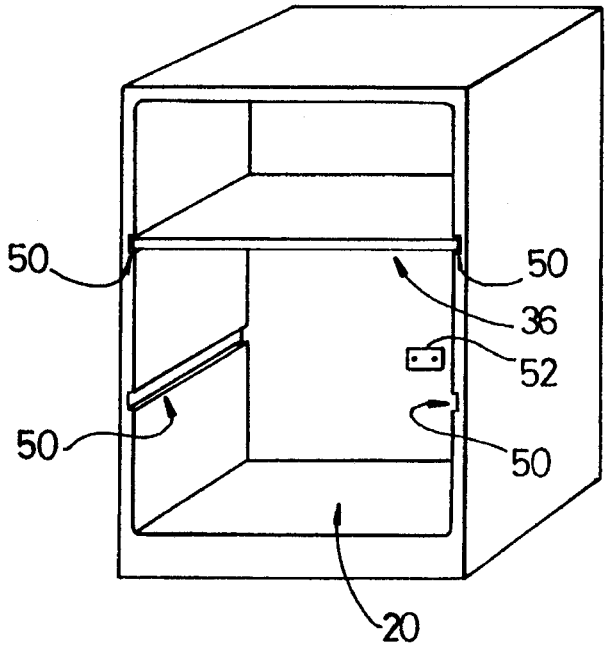

FIG. 4 shows a cross-sectional view through the oven unit 4 of FIG. 1 along the lines X—X. The oven unit 4 includes an oven cavity having a lower cooking space 20 and upper cooking space 22, separated by a removable partition 36. The removable partition 36 includes integral heating means 38. The heating means 38 may be used, for example, to facilitate the use of the upper cooking space 22 as an oven or, alternatively, if the partition 36 is turned over then the lower cooking space 20 may be usable as a grill.

The heating means 28 may include components for heating more than one cavity (38,38'), and those components may be operable independently.

Furthermore, the partition 36 may be selectably locatable in a number of positions as described below, or a number of such partitions may be provided. For example, if the partition 36 is locatable at or near the top of the oven cavity 22, then the upper cooking space 22 may be usable as a grill.

The partition 36 is received in a pair of grooves 50 in opposite side walls of the oven cavity 20. In this embodiment, two such pairs of grooves 50 are provided, positioned at approximately one-third and two-thirds of the height of the oven cavity 20. The partition 36 is simply slid into the appropriate pair of grooves 50 wherein it is supported at opposite side portions.

A connector 52 is associated with each pair of grooves mounted on a rear wall of the oven cavity. The connected makes electrical contact with a cooperating connector on the partition, so as to make electrical connection therewith for supply of power to a heating element (not shown) carried on the partition. The control unit is responsive to detection of a connection being made at the connector 52 to modify its operation suitably to provide independent control of each cooking space within the oven cavity.

The door 24 of the oven unit 4 includes an upper portion 40 and a lower portion 42. The upper portion 40 is receivable in a slot 44 in the lower portion 42. Thus, with the upper portion 40 extended out of the slot 44, the door 24 may seal both oven cavities 20, 22. Alternatively, with the upper portion 40 received in the slot 44, the door 24 may only seal the lower cavity 20, thereby allowing the upper cavity 22 to be used e.g. as a grill. Alternatively, other means may be provided for facilitating movement between the upper and lower portions.

Figure 6:
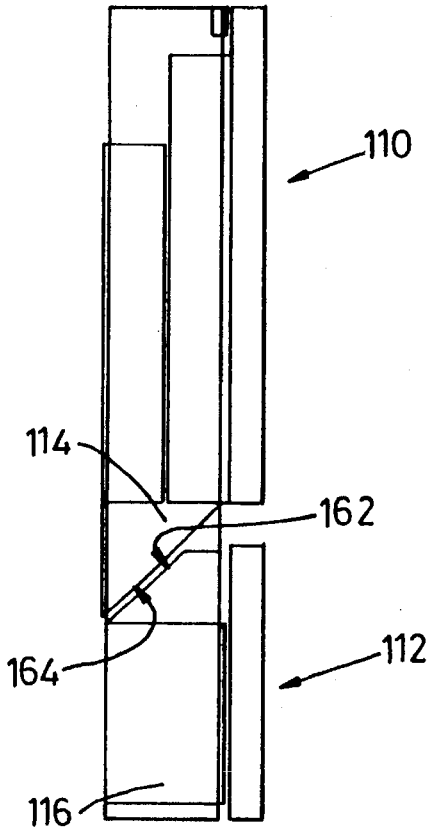
FIG. 6 is a sectional side view of a door assembly, suitable for use in a cooking appliance, embodying the present invention, for example as an alternative to that of FIG. 4.

With reference now to FIG. 6, a door assembly embodying the invention comprises a first, upper leaf 110, and a second, lower leaf 112. The upper and lower leaves 110,112 are mounted substantially adjacent one another such that, when in a closed condition (as shown in FIG. 6), they together close an aperture. Each leaf 110,112 is carried so as to be hingedly moveable about the respective axis extending horizontally close to a bottom surface of the respective leaf 110,112. Each leaf 110,112 can thus be opened by general rotation about its respective axis 114,116, independent of the other leaf, so as to reveal an opening through which access to part of the said aperture can be gained. It is to be understood that the opening movement in many cases will not consist of pure rotation about a fixed axis. In this embodiment, the opening movement of the upper leaf 110 further includes upward translational movement, with the effect that its pivotal axis moves upwardly during opening. This allows the upper leaf 110 to clear the lower leaf 112 when opened and, furthermore, facilitates sealing between the leaves 110,112.

Figure 7:
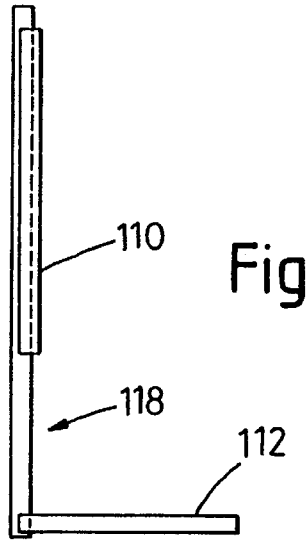
FIGS. 7 to 10 illustrate schematically various positions of two leaves of the door assembly of FIG. 6 various positions.
Figure 8:
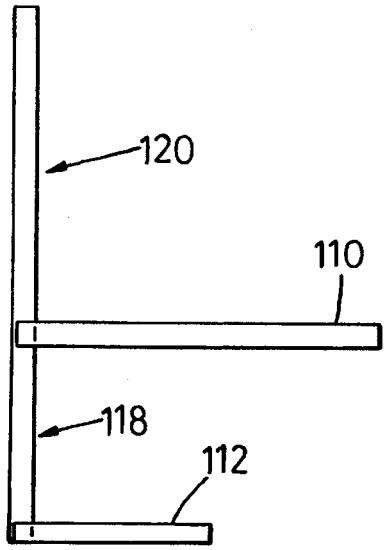
Figure 9:
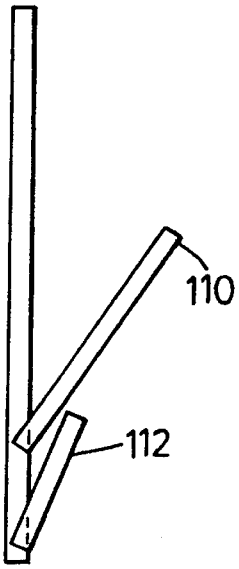
Figure 10:
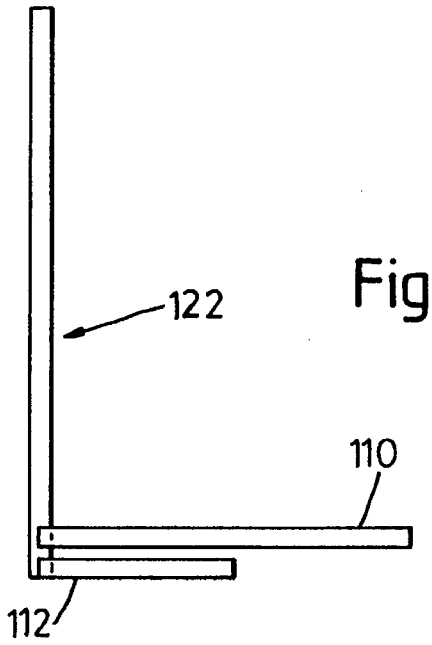

With reference to FIGS. 7 to 10, the door assembly of FIG. 6 is shown in various opening states. In FIG. 7, the lower leaf 112 is open to give access to a lower opening 118, and as shown in FIG. 8, the upper leaf 110 is also open to give simultaneous access to an upper opening 20. FIG. 4 shows the door assembly in an intermediate condition in which the upper leaf 110 has been partially opened and displaced downwardly, resulting in partial opening of the lower leaf 112. Continuing such downward displacement, and opening fully of the upper leaf causes the door assembly to adopt a fully open condition, as shown in FIG. 10, in which unobstructed access to a large aperture 122 (being largely co-extensive with the upper and lower openings 120,118).

Figure 11:
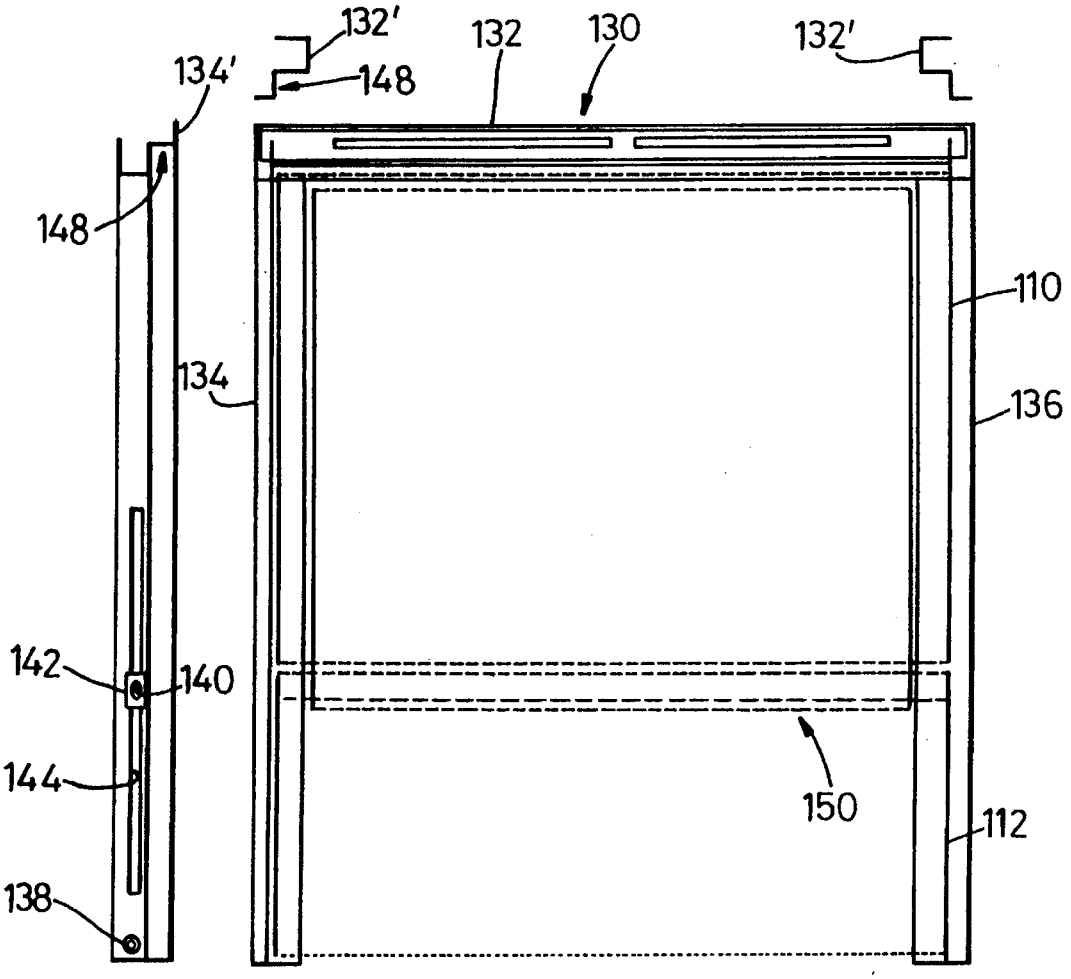
FIG. 11 is a front view of a cooking appliance having a door assembly embodying the invention.

FIG. 11 shows diagrammatically a door assembly embodying the present invention mounted upon the chassis of a cooking appliance 130. The door assembly includes channel section 132,134,136 mounted, respectively, adjacent upper, and left and right side peripheral boundaries to the aperture 122. The cross-sectional shape of the upper channel section is shown in FIG. 11 at 132' and the cross-sectional shape of the left side channel section is shown at 134', the cross-sectional shape of the right and channel section 136 being similar.

In the arrangement shown in FIG. 11, the lower leaf 112 is pivotally mounted onto the side channel sections 134,136, the point of attachment to the channel sections, and the axis about which the lower leaf rotates, being indicated at 138. The upper leaf 110 is carried for hinging movement about a pivot 140 in each of a pair of blocks 142L,142R carried on a respective side channel section 134,136. Within each channel section 134,136, the respective block 142 is carried in an elongate, vertically orientated slot 144 so as to be vertically slidable. In this manner, the upper leaf 110 is permitted vertical sliding movement as well as hinging movement about its axis.

Each of the channel sections 132,134,136 (which may have identical cross-sectional shapes) presents an outwardly directed step for receiving an edge portion of the leaves. The step includes an outwardly directed sealing surface 148 disposed substantially parallel to the plane of the leaves 110,112 when in their closed conditions. A sealing strip (not shown) is disposed extending along the sealing surfaces 148 such that it is compressed against edge portions of the inner surface of the leaves 110,112 when in their closed condition, so as to provide a peripheral, partially air-tight seal around the leaves 110,112. Alternatively, or additionally, sealing elements may be provided on the leaves 110,112 themselves, sufficient so as to be compresses between the leaf and the sealing surface 148 when the leaves 110,112 are in their closed conditions.

It will be seen that, in addition to the above described sealing arrangements, steps must be taken to ensure that a seal is provided to act between the leaves 110,112. To this end, a lower portion of the upper leaf 110 is arranged to overlap with an upper portion of the lower leaf 112 as shown generally at 150 in FIG. 11, and in more detail in FIG. 6. As will be seen in FIG. 6, at is upper extremity, the lower leaf 112 carries a chamfer, so providing an inwardly and upwardly directed sealing surface 162. A complimentary sealing surface 164 is provided on the upper leaf 112, the sealing surfaces 162,164 being arranged to be parallel and closely approach one another when the leaves 110,112 are in their closed condition. A sealing element (not shown) is provided on one or both sealing surfaces 162,164, their each sealing element being compresses between the surfaces 162,164 when the leaves 110,112 are closed so as to provide a semi-air-tight seal therebetween. It will be appreciated that such a seal is compressed by both the vertical translation and pivotal movement of the upper leaf 110 as it is closed.

Figure 12:
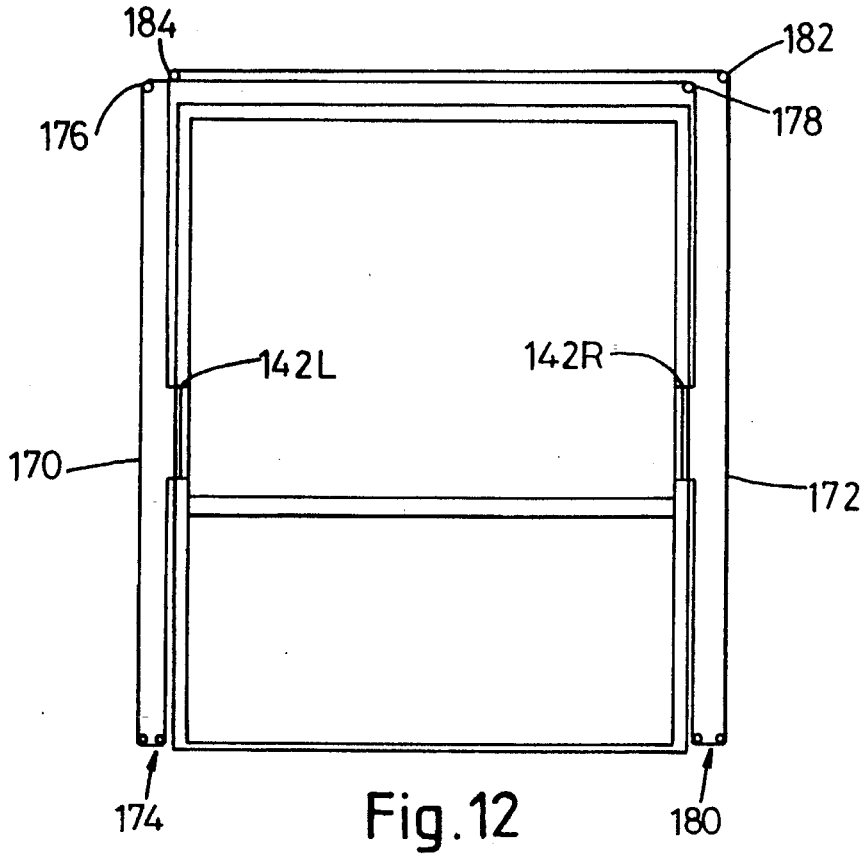
FIG. 12 is a front view of a cooking appliance for controlling movement of a first leaf of the door of FIG. 6 during displacement thereof.

Each block 142 is connected to a movement control means, the object of which is to ensure, as far as possible, that the movement of the blocks 142 in their respective slots 144 is synchronised so, effectively, resisting rotational movement of the lower leaf while allowing vertical displacement of it. An arrangement of such control means is shown diagrammatically in FIG. 12.

The control means comprises a pair of cables 170,172 each connected so as to apply to a first of the blocks 142L a downward tensional force and to the other of the blocks 142R an upward tensional force, the cables 170,172 being symmetrically arranged such that each block is connected upwardly to one of the cables and downwardly to the other.

The first cable 170 extends from the block 142 on the left side of the aperture, downwardly to a pair of pulleys 174. The cable 170 wraps around the pulleys 174 from which it extends upwardly to a pulley 176 located above and to the left of the aperture. From the pulley 176, the cable 178 extends horizontally to a pulley 178 located above and to the right of the aperture, from which it extends downwardly the right-hand block 142R. It will be seen that upward movement of the left-hand block 142L causes movement in the cable 170 which, in turn, causes similar upward movement of the right-hand block 142R. The situation is reversed wherein downward movement of the right-hand block 142R causes similar downward movement to occur in the left-hand block 142L. The second cable 172 is connected in a manner similar to that of the first cable 170 so as to extend downwardly from the right-hand block 142R, around a pair of pulleys 180, then upwardly to pulley 182, horizontally to pulley 184, and downwardly to the left-hand block 142. This causes downward movement of the left-hand block and upward movement of the right-hand block to be followed by its opposite number. The two cables 170,172 thereby provide complete control of movement of the two blocks, and resist movement of one block independently of the other.

Figure 13:
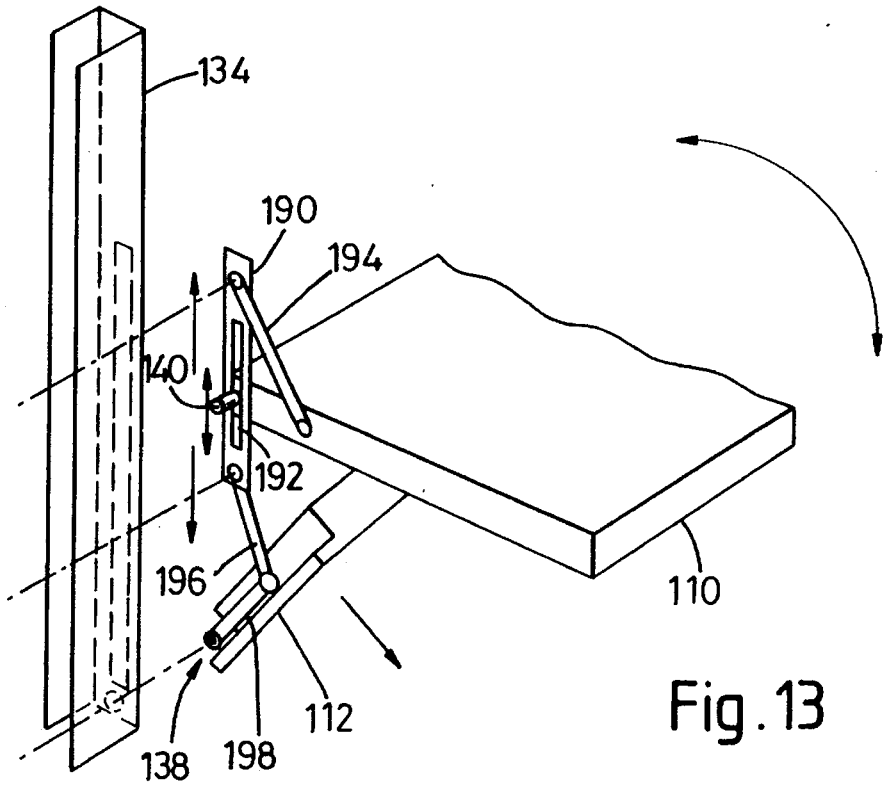
FIG. 13 is a schematic illustration of a hinge mechanism for a door assembly of the present invention.

With reference to FIG. 13, there is provided a linkage mechanism interconnecting the upper and lower leaves 110,123. The linkage mechanism comprises a sliding member 190 mounted upon one of the side members 134 for sliding movement longitudinally thereof. The sliding member 190 has a slot 192 extending partially along its length through which the pivot 140 passes for engagement with the block 142 (not shown in FIG. 13) as described above.

An upper link 194 is pivotally connected, at a first end portion, to the sliding member 190 between its upper end and the slot 192. At an opposite end portion of the link 194, it is pivotally connected to the upper leaf 110. The pivotal connections of the link 194 have axes parallel to that of the pivot 140 of the upper leaf 110.

A lower link 196 is pivotally connected, over a first of its ends, to a lower end portion of the sliding member 190, and near its opposite end to a third member 198. The third member 198 is further pivotally connected near it slower end to an axis substantially coaxial with the pivotal axis 138 of the lower leaf 112.

A similar linkage is provided at the opposite side of the oven.

In operation, starting with both leaves closed, the lower leaf 112 can be pivotally opened in a conventional manner. However, the upper leaf 110 when opened pivots about a horizontal axis on its pivot 140. The upper link 194 simultaneously acts to cause the pivot 140 to slide upwardly in the slot 192. The result of this is that seals disposed between the upper and lower leaves 110,112 are compressed by both the pivotal and sliding movement of the leaves, so achieving a greater degree of sealing effectiveness than would be possible with pivotal movement alone.

Again, with both leaves closed, if the upper leaf 110 is first opened by a small amount, it may then be displaced vertically downwards under the control of the above described control means. The upper link 194 transmits the downward movement causes the lower link 196 and the third link 198 to be displaced such that their common pivot moves outwardly. The third link 198 then contacts the lower leaf 112, causing it to open, so providing clearance to allow continued downward movement of the upper leaf 110.

The lower leaf 112 is provided with biasing means to urge it towards its closed position within the range of movement caused by linkage, as described above. This causes the lower leaf 112 to close once the upper leaf 110 is displaced upwardly to its closed position.

As an additional safety feature, means (not shown) are provided which are operative to prevent vertical displacement of the upper leaf when it is pivotally displaced more than a predetermined amount (for example 70° from its closed position. This is important in an oven where in open oven door is often used as a support for heavy articles being inserted into or removed from the oven. Vertical movement of the door when an article is placed upon it could result in spillage and possible injury.

The above description is given only by way of example, and modifications will be apparent to a person skilled in the art. For example, the invention could be applied in all of its aspects to an oven for use in a commercial environment. Such ovens are larger than their domestic equivalents and would typically be provided with several partitions by means of which a commercial user could be provided with the benefit of greatly versatile operation.

What I claim is:

1. A cooking appliance comprising an oven unit, the oven unit being adapted to be built into a space within an item of kitchen furniture having a cooking cavity, the cooking appliance further comprising a control unit for the oven unit, and a hob unit separate from the oven unit, the control unit incorporating at least one control operable by a user to control operation of the oven unit and at least one further control operable by a user to control operation of the hob unit, the control unit being mounted on the hob unit remote from the oven unit, outside of the said space, so as to permit a volume within the cooking cavity to be maximized within the space.

2. A cooking appliance according to claim 1 in which the cavity of the oven unit is divided to comprise a plurality of cooking cavities and the control unit comprises a plurality of controls by means of a respective one of which a cooking temperature in each of the plurality of cooking chambers of the oven unit can be independently controlled.

3. A cooking appliance comprising an oven unit, the oven unit comprising an oven cavity into which food to be cooking can be place, a partition received within the cavity to divide the cavity into a plurality of cooking spaces, a cooking temperature of each cooking space being independently controllable, the cooking appliance comprising further a control unit, and detection means for detecting the presence of or absence of the partition, the detection means begin operative to modify the operation of the control means.

4. A cooking appliance according to claim 3 in which the partition carried heating means to heat a cooking space of the oven unit.

5. A cooking appliance according to claim 3 in which the partition can be selectively received within the oven cavity in a plurality of positions.

6. A cooking appliance according to claim 3 in which the partition can be selectively installed or removed by an operator of the cooking appliance.

7. A cooking appliance according to claim 3 in which the partition is installed during manufacture of the oven unit.

8. A cooking appliance according to claim 3 in which the partition is insulated to provide a thermal barrier between cooking spaces within the oven cavity.

9. A cooking appliance according to claim 3 in which the control unit includes at least two oven controls, each oven control being operative to control a respective cooking space when the partition is in place in the oven cavity.

10. A cooking appliance according to claim 9, in which one of the oven controls is disabled and another is operative to control the entire oven cavity on removal of the partition from the oven cavity.

11. A cooking appliance according to claim 3 in which the control unit comprises one or more hob controls each adapted to control a respective cooking element of a hob unit and more than one oven control each adapted to control a respective cooking space of the oven unit, the control unit being adapted for mounting remote from the oven unit.

12. A cooking appliance comprising a door assembly which door assembly comprising first and second leaves arranged, in a closed condition, to be adjacent one another and each hingedly mounted to be openable independently of the other through pivoting about respective spaced parallel axes to reveal a respective opening, in which the first leaf is mounted such that its axis is displaceable in a direction normal to the axes towards the axis of the second leaf, in which displaced condition the opening of the first and second leaves reveals a single opening of size greater than that of either said respective opening, the first leaf being mounted on a linkage assembly, which linkage assembly functions to secure the first leaf onto the cooking appliance which linkage assembly comprises hinge components to which the leaf is hingedly mounted and occurring components which connect the hinge components to the cooking appliance such that the hinge components are displaceable in said direction normal to the axes, and which linkage assembly comprises urging members which, on displace of the hinge components, move to urge the second door leaf from its closed condition towards its open position.

13. A cooking appliance according to claim 12 in which the door assembly further includes control means whereby displacing movement of the first leaf is restricted to a path substantially normal to its hinging axis, and rotation of the first leaf about any other axis is inhibited.

14. A cooking appliance according to claim 13 in which the control means comprises tensioned wires disposed so as to cause displacement of one of the hinge parts to be similarly imposed on the other hinge part.

15. A cooking appliance according to claim 12 in which the first and second axes are horizontal, the first being disposed above the second, such that displacement of the first leaf is accomplished by a downward push on a upper part of the leaf.

* * * * *